US007464904B2

(12) United States Patent
Vehar et al.

(10) Patent No.: US 7,464,904 B2
(45) Date of Patent: Dec. 16, 2008

(54) METHOD AND SYSTEM PROVIDING SLEEP AND WAKE-UP MODES FOR RAILWAY TRACK CIRCUIT UNIT

(75) Inventors: Richard W. Vehar, Sewickley, PA (US); Raymond C. Franke, Glenshaw, PA (US)

(73) Assignee: Union Switch & Signal, Inc., Pittsburgh, PA (US)

( * ) Notice: Subject to any disclaimer, the term of this patent is extended or adjusted under 35 U.S.C. 154(b) by 609 days.

(21) Appl. No.: 10/554,673

(22) PCT Filed: Apr. 28, 2004

(86) PCT No.: PCT/US2004/013021

§ 371 (c)(1),
(2), (4) Date: Oct. 27, 2005

(87) PCT Pub. No.: WO2004/098975

PCT Pub. Date: Nov. 18, 2004

(65) Prior Publication Data

US 2006/0249631 A1 Nov. 9, 2006

Related U.S. Application Data

(60) Provisional application No. 60/466,894, filed on Apr. 30, 2003.

(51) Int. Cl.
*B61L 21/00* (2006.01)

(52) U.S. Cl. ..... 246/34 A; 246/5; 246/1 C; 246/28 E; 246/292; 340/10.33; 340/10.34; 340/10.31

(58) Field of Classification Search ..... 246/28 R, 246/34 R, 38, 34 A, 34 B, 58, 122 R, 1 R, 246/1 C, 28 E, 28 G, 28 F, 219, 292, 473 R; 340/10.34, 10.31, 10.33; 323/318, 909
See application file for complete search history.

(56) References Cited

U.S. PATENT DOCUMENTS 5,459,663 A 10/1995 Franke (Continued)

FOREIGN PATENT DOCUMENTS

DE 198 30 053 C1 11/1999

(Continued)

*Primary Examiner*—Mark T Le
(74) *Attorney, Agent, or Firm*—Kirk D. Houser; Eckert Seamans Cherin & Mellott, LLC

(57) ABSTRACT

A method provides sleep and wake-up modes for railway track circuit units. An intermediate track circuit unit communicates in a first direction to a first unit and in a different second direction to a different second unit. A plurality of wireless messages are employed between a train and a plurality of wayside units operatively associated with some of the track circuit units. Included with the wireless messages are a first identifier of a corresponding one of the track circuit units and a second identifier of a direction of travel of the train. One of the wireless messages is received at one of the wayside units corresponding to the intermediate unit based upon the first identifier. A signal is responsively output based upon the second identifier from the intermediate unit in the first direction to the first unit or in the different second direction to the different second unit.

32 Claims, 2 Drawing Sheets

U.S. PATENT DOCUMENTS 5,465,926 A 11/1995 Brown
5,835,719 A * 11/1998 Gibson et al. ..... 709/221
5,947,423 A 9/1999 Clifton et al.
6,049,885 A * 4/2000 Gibson et al. ..... 713/324
6,144,900 A 11/2000 Ali et al.
6,175,784 B1 1/2001 Jicha et al.
6,276,542 B1 8/2001 McCrary
6,850,539 B1 * 2/2005 Cassiers et al. ..... 370/465

FOREIGN PATENT DOCUMENTS

EP 0 748 084 A1 12/1996
EP 0 748 085 A1 12/1996

* cited by examiner

METHOD AND SYSTEM PROVIDING SLEEP AND WAKE-UP MODES FOR RAILWAY TRACK CIRCUIT UNIT

CROSS-REFERENCE TO RELATED APPLICATION

This application is related to commonly assigned U.S. Provisional Patent Application Ser. No. 60/466,894, filed Apr. 30, 2003, entitled: "Method and System Providing Sleep Mode for Coded Railway Track Circuit Unit".

BACKGROUND OF THE INVENTION

1. Field of the Invention

The present invention relates to a method and system for reducing power consumption in a coded railway track circuit. More particularly, the invention relates to a method and system for placing a coded railway track circuit apparatus into a reduced power, sleep mode during periods of low vehicle activity.

2. Background Information

In the art of railway signaling, traffic flow through signaled territory is typically directed by various signal aspects appearing on wayside indicators or cab signal units located on board railway vehicles. The vehicle operators recognize each such aspect as indicating a particular operating condition allowed at that time. Typical practice is for the aspects to indicate prevailing speed conditions.

For operation of this signaling scheme, the track is typically divided into cascaded sections known as "blocks." These blocks, which may be generally as long as about two to about five miles in length, are electrically isolated from adjacent blocks by typically utilizing interposing insulated joints. When a block is unoccupied, track circuit apparatus connected at each end are able to transmit signals back and forth through the rails within the block. Such signals may be coded to contain control data enhancing the signaling operation. Track circuits operating in this manner are referred to as "coded track circuits." One such coded track circuit is illustrated in U.S. Pat. No. 4,619,425. When a block is occupied by a railway vehicle, shunt paths are created across the rails by the vehicle wheel and axle sets. While this interrupts the flow of information between respective ends of the block, the presence of the vehicle can be positively detected.

U.S. Pat. No. 5,465,926 discloses a coded track circuit repeater having a standby mode. The coded railway track circuit apparatus has the capability of operating during periods of low vehicle activity in a reduced power standby mode. This is accomplished by switching circuitry, which interrupts power to most of the components within the track circuit apparatus in response to the recognition by standby initiation circuitry of a preselected standby initiation signal. Power to fail-over indicators, which would normally be activated due to a power failure, is also interrupted by fail-over interrupt circuitry. During the standby mode, monitor circuitry remains active and awaits reception of a preselected wake-up signal. The wake-up signal may be a unique signal or a link-up signal such as is periodically transmitted by some coded track circuit units during periods when the block is occupied. For example, the wake-up signal is received by a hardware filter, which recognizes that a track message was received. Operation is limited to a single direction, with the intent being to wake-up an entire series of track circuit units between two control points. Hence, in order to initiate train movement, it is required to wake-up several track circuit units with an inherent and probably excessive time delay (e.g., several minutes, depending on the number of track circuits).

This places a coded railway track circuit apparatus into a reduced power standby mode during periods of low vehicle activity. When the wake-up signal is received, full power is restored, thus resuming normal operation. Operation of the fail-over systems is also then re-established. See, also, U.S. Pat. No. 5,145,131.

U.S. Pat. No. 5,459,663 discloses a cab signal apparatus and method. Various track relays are used to form a selection network, which picks the code rate that represents the speed at which the train must not exceed. To avoid a second train from following a first vehicle into a block, vital track relays cut off the cab signals in the track circuit immediately behind the train. The relay circuitry applies cab signals to the block in which the train is located, while removing the cab signal from the block behind the moving vehicle. To avoid interference between multiple cab signal units transmitting simultaneously and to conserve power, it is desirable to turn-off as many cab signal transmitters as possible in front of and behind the moving vehicle. It is also desirable to turn-off the cab signal unit in the block immediately following the vehicle to avoid having a second vehicle enter that block and erroneously receive the cab signal.

U.S. Pat. No. 6,144,900 discloses a linear array of N wireless nodes, in which each node can communicate with its K-nearest-neighbors and has a unique identification by which it can be addressed. The network of nodes, in a preferred embodiment, constitutes a train with a clearly designated head-node in the lead locomotive at one end of the train, the other nodes of the network being specific cars of the train. The last car in the train is the end-of-train. Each node conserves battery power by enabling the radio to be in a powered-down or "sleep mode" and by reducing the duty cycle of the communication receiver portion of the radio.

U.S. Pat. No. 6,175,784 discloses a remotely operable rail car status monitor and control system, which includes a plurality of handbrake sensor and release monitors (HSRMs) configured for radio frequency (RF) communication with a handheld data terminal (HDT). A wake-up receiver is configured to receive wake-up commands from the HDT. The wake-up command is a single pulse capable of simultaneously "waking up" all the HSRMs within its range. Upon the detection of a wake-up command by the receiver, a microcontroller transitions from its Sleep state to its Normal state. The microcontroller can be programmed to transition from its Sleep state to its Normal state when motion greater than a slid wheel threshold level is sensed and a handbrake sensor indicates that a handbrake is in its applied state.

U.S. Pat. No. 6,276,542 discloses a transit system in which on-board computers (OBCs) of personal vehicles (PVs) communicate with a Master computer for a controlled roadway, providing a range of functions. Communication between the Master and the OBCs is wireless through a leased or dedicated cell network. The OBCs for active PVs are preferably never turned off, but rather put into a sleep mode. The Master may wake up any OBC within its communication range, and update data and functions with that OBC.

European Patent Application No. EP0748084 discloses a mode of communication for asset tracking units, which mode involves communication between a central station and individual tracking units using a primary satellite communication link. A secondary "mutter" mode of communication conserves power and employs local communication between the tracking units as opposed to direct satellite communication with the central station.

European Patent Application No. EP0748085 discloses a multiple load tracking system employing a global positioning system in which a master unit sleeps until a slave unit polling time.

German Patent Application No. DE019830053 discloses a train monitoring device employing wagon communication devices linked to an onboard computer for a locomotive and each wagon of the train. The wagon communication devices communicate with a monitoring center via a long distance communication link and with one another via a short distance communication link. Polling of the data is provided by each wagon communication device, which is normally held in a sleep mode.

Hence, there is room for improvement in methods and systems for reducing power consumption in a coded railway track circuit.

SUMMARY OF THE INVENTION

These needs and others are met by the present invention, which provides a sleep mode and a wake-up mode for a plurality of railway track circuit units. A wireless message is employed between a train and a wayside unit operatively associated with one of the track circuit units. The wireless message includes a first identifier of a corresponding one of the track circuit units and a second identifier of a direction of travel of the train. The wireless message is received at the wayside unit corresponding to the one of the track circuit units based upon the first identifier. In response, the corresponding one of the track circuit units enters the wake-up mode from the sleep mode and responsively outputs based upon the second identifier a signal in the first direction to the first track circuit unit or in the different second direction to the different second track circuit unit.

As one aspect of the invention, a method of providing a sleep mode and a wake-up mode for a plurality of railway track circuit units comprises: adapting one of the track circuit units to communicate in a first direction to a first track circuit unit and in a different second direction to a different second track circuit unit; employing a plurality of wireless messages between a train and a plurality of wayside units operatively associated with at least some of the track circuit units; including with the wireless messages a first identifier of a corresponding one of the track circuit units and a second identifier of a direction of travel of the train; receiving one of the wireless messages at one of the wayside units corresponding to the one of the track circuit units based upon the first identifier and responsively entering the wake-up mode from the sleep mode of the one of the track circuit units; and responsively outputting based upon the second identifier from the one of the track circuit units a signal in the first direction to the first track circuit unit or in the different second direction to the different second track circuit unit.

The method may include approaching the one of the wayside units with the train in the first direction; sending the one of the wireless messages from the train including the second identifier for the first direction; and receiving the one of the wireless messages at the one of the wayside units and responsively outputting from the one of the track circuit units the signal in only the first direction to only the first track circuit unit, in order to wake-up only the first track circuit unit.

The method may further include, based upon the second identifier, determining whether one of a first track circuit in the first direction to the first track circuit unit is clear or whether a second track circuit in the second direction to the second track circuit unit is clear; and broadcasting another one of the wireless messages from the one of the wayside units including the first identifier to identify the one of the track circuit units and a third identifier to indicate whether the one of the first and second track circuits is clear.

The method may include employing as the train a first train; employing the first train approaching the one of the track circuit units in a first direction; employing as one of the wireless messages a first wireless message; sending the first wireless message from the first train; employing a second train approaching the one of the track circuit units in an opposite second direction; sending a second wireless message from the second train; and receiving at least one of the first and second wireless messages at the one of the wayside units corresponding to the one of the track circuit units and responsively entering the wake-up mode of the one of the track circuit units.

The method may include, independent of a response to the signal, receiving an input indicating that the first track circuit is not clear; broadcasting another one of the wireless messages from the one of the wayside units including the first identifier to identify the one of the track circuit units and a third identifier to indicate that the first track circuit is not clear; and entering the sleep mode at the one of the track circuit units.

As another aspect of the invention, a railway system for a train including a wireless transmitter comprises: a plurality of railway track circuit units, one of the track circuit units being adapted to communicate in a first direction to a first one of the track circuit units and in a different second direction to a different second one of the track circuit units, each of the track circuit units including a power supply having a control input; and a plurality of wayside units operatively associated with the track circuit units, each of the wayside units including a control circuit, a wireless receiver and a wireless transmitter, the wireless receiver being adapted to receive a plurality of wireless messages from the wireless transmitter of the train, each of the wireless messages including a first identifier of a corresponding one of the track circuit units and a second identifier of a direction of travel of the train, the control circuit being adapted to respond to receipt of one of the wireless messages and set the control input of a corresponding one of the track circuit units, in order to enable the power supply thereof and enter a wake-up mode thereof, wherein one of the wayside units is adapted to receive one of the wireless messages corresponding to one of the track circuit units based upon the first identifier and to responsively enable output based upon the second identifier from the one of the track circuit units a signal in the first direction to the first track circuit unit or in the different second direction to the different second track circuit unit.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

U.S. Pat. No. 5,465,926, which discloses a coded track circuit repeater and monitor circuitry, is incorporated by reference herein.

The present invention is disclosed in connection with a railway signaling system, which is very power efficient and, therefore, attractive for use in remote areas where solar or alternatives to commercial power are relatively less expensive. The system is predominately de-energized, thereby consuming relatively little power. The system is activated only to assist safe passage of trains on an as needed basis.

Figure 1:
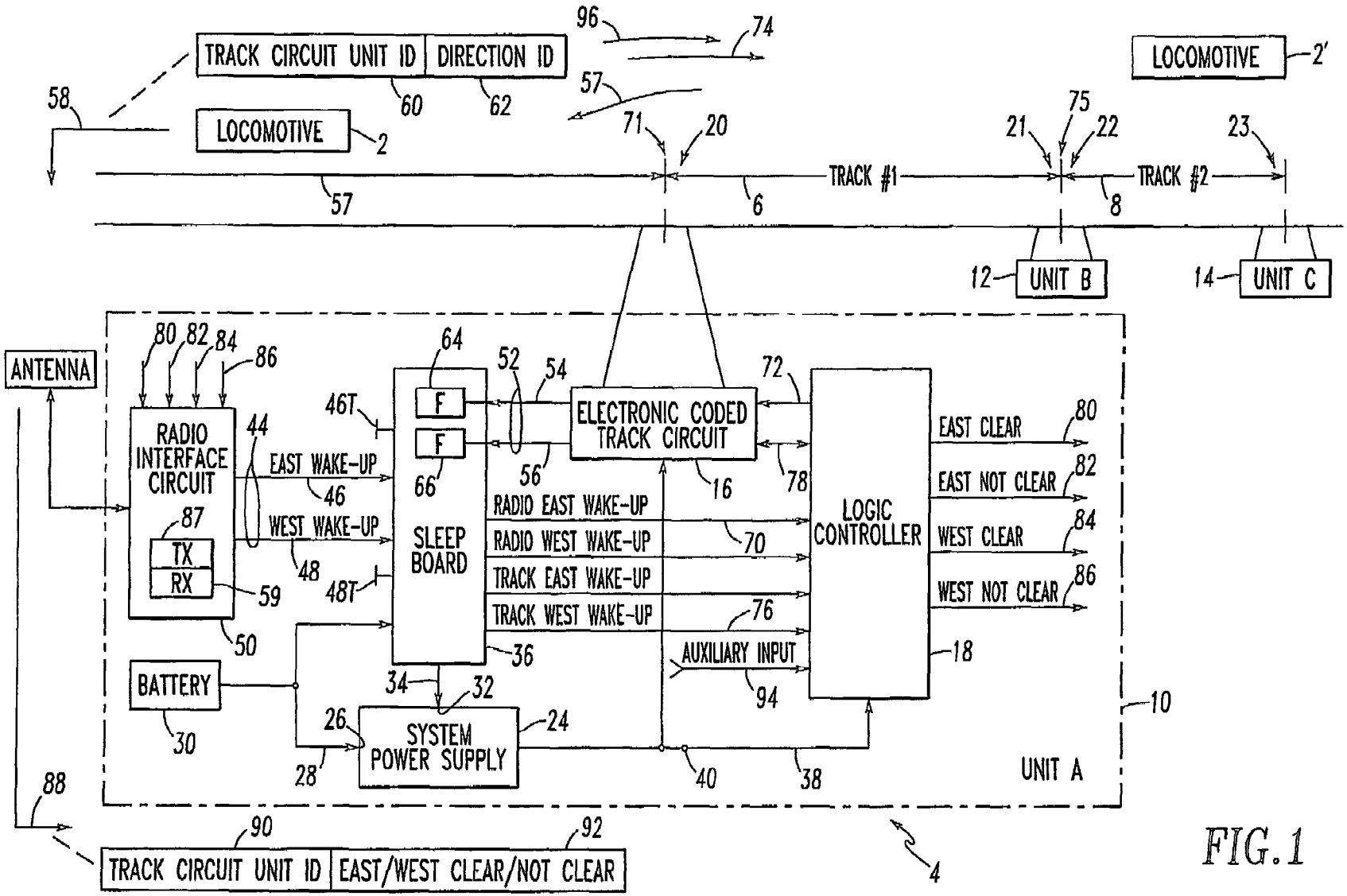
FIG. 1 is a block diagram of a railway track circuit system in accordance with the present invention.

One such embodiment is illustrated in FIG. 1. In some areas, trains operate without the benefit of a signaling system and, therefore, without the benefit of broken rail detection that a signaling system, with track circuits, would otherwise provide. In this system, wayside signals are replaced by two-way radio communication between a locomotive, such as 2, and a wayside unit, such as 4. Each end of a track circuit, such as Track #1 6 and Track #2 8, is equipped with a track circuit unit, such as Unit A 10, Unit B 12 and Unit C 14. Except for their different locations, the various Units 10,12,14 include the same circuits and functions.

An electronic coded track circuit 16, under control of a microprocessor-based logic controller (LC) 18, is employed to communicate information from one end of a track circuit, such as West end 20 of Track #1 6, to East end 21 of Track #1 6. Similarly, the electronic coded track circuit 16 (not shown) of Unit B 12 is employed to communicate information from the East end 21 of Track #1 6 to West end 20 of Track #1 6, and to communicate information from one end of a track circuit, such as West end 22 of Track #2 8, to East end 23 of Track #2 8. Hence, the failure of a message from electronic coded track circuit 16 of Unit A 10 to be communicated to the corresponding electronic coded track circuit 16 (not shown) of Unit B 12 (i.e., between the ends of that track circuit), indicates either that the rail of Track #1 6 is broken or that such track is shunted by a train (not shown) on the track. In this case, the message is primarily employed to test the integrity of the track. An example of the hardware (but excluding the software) of the LC 18 is the programmable controller and Input/Output boards of the Microlok® II Wayside Control System marketed by Union Switch & Signal, Inc. of Pittsburgh, Pa. In the exemplary embodiment, the electronic coded track circuit 16 is the same as the transmitter and receiver of U.S. Pat. No. 5,465,926, which employs a Microtrax® electronic railway track circuit marketed by Union Switch & Signal, Inc. of Pittsburgh, Pa. Alternatively, the electronic coded track circuit 16 may be an ECode™ electronic circuit for use in railway tracks, as also marketed by Union Switch & Signal, Inc. of Pittsburgh, Pa.

The track circuit Unit A 10 includes a system power supply 24 having two inputs. The first input 26 has a suitable voltage 28, which is supplied by a wayside battery 30. The second input 32 has an ON/OFF signal 34, which is output by a sleep board 36. Whenever the ON/OFF signal 34 has the ON state, the system power supply 24 outputs a regulated voltage 38 on line 40 to the LC 18. Line 40 also powers the electronic coded track circuit 16. Circuit 16 does not get power from the battery 30 directly; it is indirectly supplied by the system power supply 24. In all cases, regardless whether the wake-up is track or radio, the sleep board 36 activates the system power supply 24. The sleep board 36 does not recognize a specific track wake-up message, such as 57, but responds to low frequency activity on the track, characteristic of a track message, and turns on the system power supply 24. Hence, for the ON state, the track communication is operational.

On the other hand, whenever the ON/OFF signal 34 has the OFF state, the system power supply 24 output line 40 is off and the track circuit Unit A 10 is in a sleep mode associated with minimum power consumption. During the sleep mode, the sleep board 36 draws power from the battery 30, albeit in a relatively small proportion to the overall power required when the track circuit Unit A 10 is awake and operating.

The sleep board 36 accepts two different sets of inputs. The first set 44 includes two signals 46,48, which are received from a radio interface circuit 50. The second set 52 includes two signals 54,56, which are received from the electronic coded track circuit 16. The signal 54 corresponds to the track 57 to the left or West of track circuit Unit A 10, while the signal 56 corresponds to the Track # 1 6 to the right or East of track circuit Unit A 10. In the exemplary embodiment, the signals 46,48,54,56 are employed by the sleep board 36 to determine whether to assert the ON state of the ON/OFF signal 34. For example, the radio interface circuit 50 receives radio frequency communications 58 at radio receiver (RX) 59 from trains, such as locomotive 2. Those communications 58 include an identifier 60 of the particular track circuit unit, such as Unit A 10, and an identifier 62 of the direction of travel of that particular train, such as East or West. When the radio interface circuit 50 receives the radio frequency communication 58, which is directed to the particular track circuit Unit A 10, as identified by the identifier 60, the circuit 50 outputs the signal 46 to indicate an East Wake-up if the identifier 62 is East, and outputs the signal 48 to indicate a West Wake-up if the identifier 62 is West. In the exemplary embodiment, the signals 46,48 are communicated in the form of contact closures and are employed to initiate wake-up on the opposite side of the insulated joint (e.g., joint 71) which a train is approaching. Alternatively, any suitable type of signal may be employed (e.g., logic level signals).

The signals 54,56 from the electronic coded track circuit 16, as input from track messages, such as 57, are employed by the sleep board 36, in order to wake-up the track circuit end from which the train, such as locomotive 2, will exit. For track wake-up, the sleep board 36 includes filters (F) 64,66, which respond to the low frequency components of the signals 54,56, respectively. The sleep board 36 may preferably include two test buttons 46T,48T, which respectively simulate the occurrence of the signals 46,48 for testing purposes in a system without radio communications.

EXAMPLE 1

A train, such as locomotive 2, is approaching the track circuit Unit A 10 in an Easterly direction (e.g., from the left to the right side of FIG. 1). A radio message 58 with identifier 62 being East Wake-up is received by the radio interface circuit 50, which outputs the signal 46. The sleep board 36 activates the ON state of the ON/OFF signal 34 in order to activate the system power supply 24 and, also, sets a Radio East Wake-Up (REWU) signal 70 to the LC 18. The signal 70 instructs the LC 18 to begin track communication on the East side of the insulated joint 71 at location A. In response to a signal 72 from the LC 18 to the electronic coded track circuit 16, that circuit 16 sends a track message 74 on Track #1 6, which is received by the corresponding electronic coded track circuit 16 (not shown) of the track circuit Unit B 12. That message 74 is received on the exit or B end or East end 21 of the track circuit for Track #1 6, which is the West side of the insulated joint 75 at location B. In response, the corresponding sleep board 36 (not shown) of the track circuit Unit B 12 responds to activate the corresponding power supply 24 (not shown) and to deliver a corresponding Track West Wake-Up (TWWU) signal 76 (as shown with Unit A 10) to the corresponding LC 18 (not shown) of track circuit Unit B 12. In turn, that LC responds to initiate track communication on the West side of track circuit Unit B 12. Then, when track communication is established between both ends 20,21 of the track circuit for Track #1 6, it establishes that the corresponding rail is unbroken. Finally, with the receipt of the track message 57 at track circuit Unit A 10, the electronic coded track circuit 16 outputs signal 78 to the LC 18, which responsively outputs a signal 80, which signifies East Track Clear. Alternatively, if the rail for Track #1 6 were broken, then track circuit Unit B 12 would not awaken and attempt to return a track message through the rail to track circuit Unit A 10. In that event, the LC 18 would responsively output a signal 82, which signifies East Track Not Clear.

EXAMPLE 2

The signals 80,82,84,86 are output by the LC 18 to the radio interface circuit 50. The signal 84 signifies West Track Clear and the signal 86 signifies West Track Not Clear. The radio interface circuit 50 broadcasts (e.g., to the train initiating the wake-up) from radio transmitter (TX) 87 a message 88, which includes a first identifier 90 to indicate that the transmitter of the message 88 is the track circuit Unit A 10, and a second identifier 92 to indicate that the message corresponds to one of the signals 80,82,84,86.

EXAMPLE 3

The radio message 58 from the locomotive 2 to the wayside locations, such as the track circuit Unit A 10, may be in a periodic intermittent form (e.g., 1 second on; 15 seconds off). In this manner, when the periodic intermittent messages 58 are no longer received (e.g., after a timeout of about 30 seconds), the sleep board 36 may restore the sleep mode. This occurs as a natural progression of train movement. For example, as the locomotive 2 progresses toward Track #1 6, there is no further need to interrogate Track #1 6 and the locomotive 2 would, then, radio wake up track circuit Unit B 12, in order to interrogate Track #2 8 and the wake-up messages 58 to track circuit Unit A 10 would terminate. Then, with the radio wake-up to track circuit Unit A 10 being terminated, that unit reverts to the power saving sleep mode. In the event that test buttons 46T,48T for the respective signals 46,48 are employed, then a longer timeout period (e.g., a number of minutes; an hour) may be employed.

EXAMPLE 4

If two trains 2,2' are approaching the same track circuit (e.g., Track #1 6) from opposite directions, then both trains may initiate wake-up. Assuming that such track is clear, then each of those trains would receive respective East Track Clear (resulting from signal 80) and West Track Clear (resulting from signal 84) messages. This is a situation that likely would arise with single track dual direction running and passing sidings. Then, if one of those trains enters the particular track circuit, then the corresponding East Track Clear and West Track Clear messages would change to East Track Not Clear (resulting from signal 82) and West Track Not Clear (resulting from signal 86), respectively, because track messages would be cut-off due to a train shunting the track.

EXAMPLE 5

As shown in FIG. 1, the LC 18 includes an auxiliary input 94. This input enables the LC 18 to provide a warning of track not clear even though the rails of the track, such as Track #1 6, are intact and/or the track is not shunted by a train. A slide fence input (not shown), for example, can invoke track not clear in the event that a slide fence (not shown) is broken and, thus, there is likely debris on the rails. At the track circuit end (e.g., at Unit A 10 for Track # 1 6) at which the auxiliary input 94 is wired, the slide fence activation is direct. At the other end (e.g. at Unit B 12 for Track # 1 6), this alters the output of the corresponding signal 54 received from the corresponding electronic coded track circuit 16 of Unit B 12 from "track clear" to "track not clear" as based upon a track message 96 through the rails for Track # 1 6 from the Unit A 10 to which the auxiliary input 94 is wired. In other words, the auxiliary input 94 allows the use of special track messages, such as 96, which indicate that the track is not clear, rather than always signifying that the track is clear.

EXAMPLE 6

Figure 2:
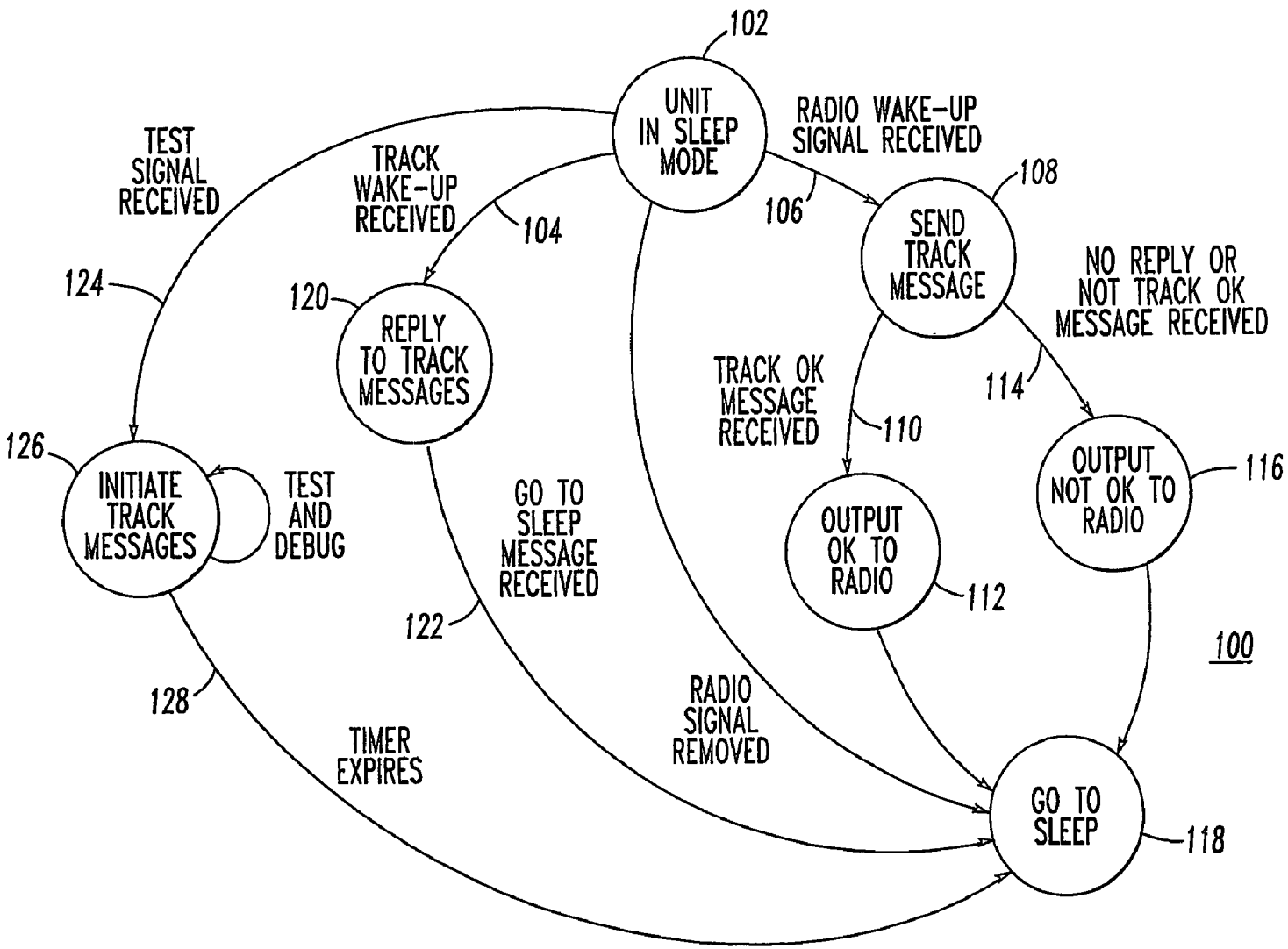
FIG. 2 is a block diagram of logic implemented by the system of FIG. 1.

FIG. 2 shows a logic diagram 100 for the system of FIG. 1. The system is normally in the sleep mode 102. When a unit, such as Unit A 10, receives a wake-up request (either from a track message 104 at circuit 16 or from a radio message 106 at circuit 50), the unit attempts to establish communications on the rails to the adjacent unit. For example, for the radio message 106, a track message is sent at 108. If that communication is successful, at 110, then an OK output through the radio interface circuit 50 is delivered at 112. Otherwise, if track communications cannot be established or if a "not track OK" message is received at 114, then a NOT OK output through the radio interface circuit 50 is delivered at 116. In this example, once the indication is delivered through the radio interface circuit 50, the unit will go back to sleep at 118.

On the other hand, for the track message 104, a track message reply is sent at 120. In this example, once a "go to sleep" track message 122 is received, the unit will go back to sleep at 118. A suitable timeout period (e.g., 45 seconds) is employed for determining that no track message was timely received.

In the event that test buttons 46T,48T for the respective signals 46,48 of FIG. 1 are employed, then the resulting test signal 124 causes the wake-up of the unit and initiation of test and debug track messages at 126. The unit will go back to sleep at 118 after a suitable timeout period (e.g., an hour) at 128.

The present system provides bidirectional communication between the track circuit Units A 10, B 12, C 14, which are awakened sequentially in an as needed basis. This system avoids excessive time delay by awaking only the circuit in advance of the train. The use of radio communications also permits such units to return to sleep in a predetermined time after the periodic intermittent messages 58 are discontinued by the trains.

Although the track circuit Units A 10, B 12, C 14 have been disclosed as being "intermediate units", such units may be employed as "end units" by omitting or by not employing circuitry and functions corresponding to one of the directions (e.g., East or West).

Although example coded track circuit Units 10,12,14 and an example logic controller (LC) 18 are disclosed, it will be appreciated that a wide range of track circuit units and/or logic controllers or processors may be employed.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A method of providing a sleep mode and a wake-up mode for a plurality of railway track circuit units, said method comprising:

adapting one of said track circuit units to communicate in a first direction to a first track circuit unit and in a different second direction to a different second track circuit unit;

employing a plurality of wireless messages between a train and a plurality of wayside units operatively associated with at least some of said track circuit units;

including with said wireless messages a first identifier of a corresponding one of said track circuit units and a second identifier of a direction of travel of said train;

receiving one of said wireless messages at one of said wayside units corresponding to said one of said track circuit units based upon said first identifier and responsively entering the wake-up mode from the sleep mode of said one of said track circuit units; and responsively outputting based upon said second identifier from said one of said track circuit units a signal in the first direction to said first track circuit unit or in the different second direction to said different second track circuit unit.

2. The method of claim 1 further comprising:

employing a first track circuit in the first direction to said first track circuit unit and a second track circuit in the second direction to said second track circuit unit;

receiving another signal responsive to said outputting based upon said second identifier from said one of said track circuit units a signal;

broadcasting another one of said wireless messages from said one of said wayside units including said first identifier to identify said one of said track circuit units and a third identifier to indicate that said one of said first and second track circuits is clear; and entering said sleep mode at said one of said track circuit units.

3. The method of claim 1 further comprising:

employing a first track circuit in the first direction to said first track circuit unit and a second track circuit in the second direction to said second track circuit unit;

receiving no response to said outputting based upon said second identifier from said one of said track circuit units a signal;

broadcasting another one of said wireless messages from said one of said wayside units including said first identifier to identify said one of said track circuit units and a third identifier to indicate that said one of said first and second track circuits is not clear; and entering said sleep mode at said one of said track circuit units.

4. The method of claim 1 further comprising:

approaching said one of said wayside units with said train in said first direction;

sending said one of said wireless messages from said train including said second identifier for said first direction; and receiving said one of said wireless messages at said one of said wayside units and responsively outputting from said one of said track circuit units said signal in only the first direction to only said first track circuit unit, in order to wake-up only said first track circuit unit.

5. The method of claim 1 further comprising:

based upon said second identifier, determining whether one of a first track circuit in the first direction to said first track circuit unit is clear or whether a second track circuit in the second direction to said second track circuit unit is clear; and broadcasting another one of said wireless messages from said one of said wayside units including said first identifier to identify said one of said track circuit units and a third identifier to indicate whether said one of said first and second track circuits is clear.

6. The method of claim 1 further comprising:

employing as some of said wireless messages a plurality of first wireless messages from said train to another one of said wayside units; and receiving one of said first wireless messages at said another one of said wayside units and responsively entering said wake-up mode of a corresponding one of said track circuit units.

7. The method of claim 6 further comprising:

periodically sending said first wireless messages from said train to said another one of said wayside units.

8. The method of claim 6 further comprising:

discontinuing to send said first wireless messages; and determining that said first wireless messages have not been received at said another one of said wayside units for a predetermined time period and responsively entering said sleep mode of said corresponding one of said track circuit units.

9. The method of claim 1 further comprising:

employing as said train a first train;

employing said first train approaching said one of said track circuit units in a first direction;

employing as one of said wireless messages a first wireless message;

sending said first wireless message from said first train;

employing a second train approaching said one of said track circuit units in an opposite second direction;

sending a second wireless message from said second train; and receiving at least one of said first and second wireless messages at said one of said wayside units corresponding to said one of said track circuit units and responsively entering the wake-up mode of said one of said track circuit units.

10. The method of claim 9 further comprising:

receiving said first wireless message, responsively determining that a first track circuit is clear and responsively sending a first track message on said first track circuit from said one of said track circuit units to said first train; and receiving said second wireless message, responsively determining that a second track circuit is clear and responsively sending a second track message on said second track circuit from said one of said track circuit units to said second train.

11. The method of claim 1 further comprising independent of a response to said signal, receiving an input indicating that said first track circuit is not clear;

broadcasting another one of said wireless messages from said one of said wayside units including said first identifier to identify said one of said track circuit units and a third identifier to indicate that said first track circuit is not clear; and entering said sleep mode at said one of said track circuit units.

12. The method of claim 1 further comprising:

entering the sleep mode of said one of said track circuit units; and receiving a wake-up request at said one of said wayside units and responsively entering the wake-up mode of said one of said track circuit units.

13. The method of claim 12 further comprising:

employing a track message as said wake-up request.

14. The method of claim 12 further comprising:

employing a wireless message as said wake-up request.

15. The method of claim 12 further comprising:

after entering said wake-up mode, attempting communications on one of a first track circuit to said first track circuit unit or on a different second track circuit to said second track circuit unit.

16. The method of claim 15 further comprising:

determining that said attempted communications were successful with said first track circuit unit and responsively outputting a corresponding wireless message to said train.

17. The method of claim 15 further comprising:

determining that said attempted communications were not successful with said first track circuit unit and responsively outputting a corresponding wireless message to said train.

18. The method of claim 13 further comprising:

employing as said track message a request track message; and receiving at said one of said wayside units a reply track message to said request track message and responsively entering said sleep mode of said one of said track circuit units.

19. The method of claim 13 further comprising:

employing as said track message a request track message; and after sending said request track message, delaying for a predetermined time period and responsively determining that no reply track message to said request track message was received.

20. The method of claim 1 further comprising:

receiving a test signal at another one of said wayside units and responsively entering said wake-up mode of a corresponding one of said track circuit units;

initiating a test and debug mode of said corresponding one of said track circuit units; and delaying for a predetermined time period and responsively entering said sleep mode of said corresponding one of said track circuit units.

21. The method of claim 1 further comprising:

employing said one of said track circuit units intermediate two different track circuits.

22. The method of claim 21 further comprising:

employing two of said track circuit units as end units; and employing each of said end units adjacent one corresponding track circuit.

23. The method of claim 1 further comprising:

entering the wake-up mode from the sleep mode of only one of said first and second track circuit units responsive to said signal.

24. A railway system for a train including a wireless transmitter, said railway system comprising:

a plurality of railway track circuit units, one of said track circuit units being adapted to communicate in a first direction to a first one of said track circuit units and in a different second direction to a different second one of said track circuit units, each of said track circuit units including a power supply having a control input; and a plurality of wayside units operatively associated with said track circuit units, each of said wayside units including a control circuit, a wireless receiver and a wireless transmitter, said wireless receiver being adapted to receive a plurality of wireless messages from the wireless transmitter of said train, each of said wireless messages including a first identifier of a corresponding one of said track circuit units and a second identifier of a direction of travel of said train, said control circuit being adapted to respond to receipt of one of said wireless messages and set the control input of a corresponding one of said track circuit units, in order to enable the power supply thereof and enter a wake-up mode thereof, wherein one of said wayside units is adapted to receive one of said wireless messages corresponding to one of said track circuit units based upon said first identifier and to responsively enable output based upon said second identifier from said one of said track circuit units a signal in the first direction to said first track circuit unit or in the different second direction to said different second track circuit unit.

25. The railway system of claim 24 wherein said control unit of one of said first one and said different second one of said track circuit units, responsive to said signal, sets the control input of a corresponding one of said track circuit units to enable the power supply and enter a wake-up mode thereof.

26. The railway system of claim 24 wherein a first track circuit extends in the first direction from said one of said track circuit units to said first track circuit unit and a second track circuit extends in the second direction from said one of said track circuit units to said second track circuit unit; wherein said one of said track circuit units is adapted to receive another signal responsive to said signal; wherein said one of said wayside units is adapted to broadcast another one of said wireless messages including said first identifier to identify said one of said track circuit units and a third identifier to indicate that said one of said first and second track circuits is clear; and wherein said control circuit is adapted to reset the control input of the corresponding one of said track circuit units, in order to disable the power supply thereof and enter a sleep mode thereof.

27. The railway system of claim 24 wherein a first track circuit extends in the first direction from said one of said track circuit units to said first track circuit unit and a second track circuit extends in the second direction from said one of said track circuit units to said second track circuit unit; wherein said one of said track circuit units is adapted to detect no response to said signal; wherein said one of said wayside units is adapted to broadcast another one of said wireless messages including said first identifier to identify said one of said track circuit units and a third identifier to indicate that said one of said first and second track circuits is not clear, and wherein said control circuit is adapted to reset the control input of the corresponding one of said track circuit units, in order to disable the power supply thereof and enter a sleep mode thereof.

28. The railway system of claim 24 wherein some of said wireless messages include a plurality of first wireless messages from said train to another one of said wayside units; and wherein said another one of said wayside units is adapted to receive one of said first wireless messages and responsively set the control input of a corresponding one of said track circuit units, in order to enable the power supply thereof and enter a wake-up mode thereof.

29. The railway system of claim 24 wherein one of said wayside units is adapted to receive a wake-up request and responsively set the control input of a corresponding one of said track circuit units, in order to enable the power supply thereof and enter a wake-up mode thereof.

30. The railway system of claim 29 wherein said wake-up request is a track message.

31. The railway system of claim 29 wherein said wake-up request is one of said wireless messages.

32. The railway system of claim 29 wherein some of said wireless messages include a plurality of first wireless messages from said train to another one of said wayside units; and wherein said another one of said wayside units is adapted to receive one of said first wireless messages and responsively set the control input of a corresponding one of said track circuit units, in order to enable the power supply thereof and enter the wake-up mode thereof.

* * * * *